United States Patent [19]

Matsuda

[11] 4,114,371

[45] Sep. 19, 1978

[54] INTERNAL COMBUSTION ENGINE

[75] Inventor: Munekazu Matsuda, Nishinomiya, Japan

[73] Assignee: Kawasaki Jukogyo Kabushiki Kaisha, Kobe, Japan

[21] Appl. No.: 672,333

[22] Filed: Mar. 31, 1976

[30] Foreign Application Priority Data

Apr. 22, 1975 [JP] Japan ..... 50-49501

[51] Int. Cl.[2] ..... F02M 13/02; F02B 75/10

[52] U.S. Cl. ..... 60/282; 123/75 B; 123/191 R

[58] Field of Search ..... 123/32 ST, 75 B, 191 R, 123/119 LR; 60/282

[56] References Cited

U.S. PATENT DOCUMENTS

| | | | |
|---|---|---|---|
| 3,211,137 | 10/1965 | Love | 123/75 B |
| 3,964,460 | 6/1976 | Nakano | 123/75 B |

*Primary Examiner*—Douglas Hart

*Attorney, Agent, or Firm*—Toren, McGeady and Stanger

[57] ABSTRACT

An internal combustion engine wherein a single cylinder is provided with a rich fuel-air mixture inlet valve for supplying rich fuel-air mixtures from a source of supply of rich fuel-air mixtures and a lean fuel-air mixture inlet valve for supplying lean fuel-air mixtures from a source of supply of lean fuel-air mixtures. The rich fuel-air mixture inlet valve and the lean fuel-air mixture inlet valve alternately open to alternately supply rich fuel-air mixtures and lean fuel-air mixtures to the cylinder. Exhaust gases discharged through an exhaust valve provided to the cylinder are delivered to an exhaust gas thermal reactor.

6 Claims, 1 Drawing Figure

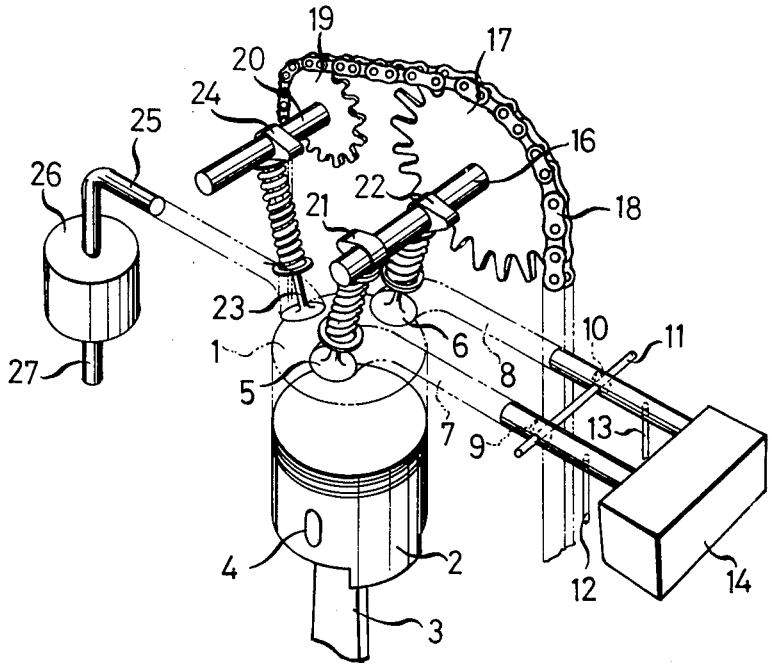
19
17
20
24
25
16
26
22
18
21
23
10
11
1
6
8
27
5
7
13
9
4
2
12
14
3

INTERNAL COMBUSTION ENGINE

BACKGROUND OF THE INVENTION

This invention relates to internal combustion engines and more particularly to an internal combustion engine mounting a novel exhaust emission control device.

Ever-increasing motor-vehicle traffic has given rise to the problem of air pollution by the exhaust gases of internal combustion engines. Various proposals have been made to solve this problem by providing various devices for cleaning the exhaust gases of the combustion engines by reducing the noxious components thereof. In the case of internal combustion engines, particularly four-stroke cycle engines, for motor vehicles, the most commonly adopted device is one which uses an exhaust manifold or a manifold thermal reactor similar to the exhaust manifold. Generally, in ordinary internal combustion engines, the fuel-air mixture drawn by suction into the engines has a theoretical air-fuel ratio and sometimes the mixture may become richer. This makes it necessary to supply excess secondary air for recombustion of exhaust gases into the exhaust port or manifold for the thermal reactor in order to promote oxidation of non-combusted hydrocarbons and carbon monoxide. The secondary air is usually supplied under pressure by means of an air pump of the vane type. Disadvantages associated with this system are that the operation of the pump has loss power and causes noise. Moreover, the air pump is low in durability.

In view of these disadvantages of supplying secondary air by means of an air pump, proposals have been made in recent years to use a system wherein a rich fuel-air mixture is supplied to a cylinder or a group of cylinders and a lean fuel-air mixture is supplied to another cylinder or another set of cylinders, and exhaust gases vented from the two cylinders or two sets of cylinders are introduced into a manifold thermal reactor, so that the exhaust gases discharged from the cylinder or cylinders for the lean fuel-air mixture are utilized as secondary air so as to do without an air pump. Additional advantage of this system lies in the fact that, since the fuel-air mixtures combusted in the cylinders are either richer or leaner than a fuel-air mixture of the theoretical air-fuel ratio, it is possible to reduce the amount of nitrogen oxides in the exhaust gases of combustion engines. However, some disadvantages are associated with this system. The need to use two cylinders as a single unit would cause unbalanced combustion between the two cylinders, fouling of the ignition plug, and distorsion of the cylinders due to differences in temperature. Moreover, even in the case of a motorcycle of compact size and light weight, the engine must have two cylinders which renders the construction of the engine complex.

SUMMARY OF THE INVENTION

This invention has as its object the provision of an internal combustion engine wherein rich fuel-air mixtures and lean fuel-air mixtures can be combusted alternately within a single cylinder, so that oxygen for use in the reactor can be automatically supplied thereto, without requiring to supply secondary air to the reactor.

The outstanding characteristic of the invention is that the cylinder mounts therein a rich fuel-air mixture inlet valve communicating with a rich fuel-air mixture supply device and a lean fuel-air mixture inlet valve communicating with a lean fuel-air supply device, and rich and lean fuel-air mixtures are alternately supplied through the two inlet valves into the cylinder.

BRIEF DESCRIPTION OF THE DRAWING

The single drawing is a schematic perspective view of a single-cylinder four-stroke cycle internal combustion engine in which the present invention is incorporated.

DESCRIPTION OF THE PREFERRED EMBODIMENT

A preferred embodiment of the invention will now be described with reference to the accompanying drawing, wherein the numeral 1 designates a cylinder mounting therein a piston 2 having attached thereto a piston pin 4 connected through a connecting rod 3 to a crank shaft (not shown). The cylinder 1 includes a cylinder head formed therein with a plurality of inlet ports which mount a lean fuel-air mixture inlet valve 5 and a rich fuel-air mixture inlet valve 6, respectively.

The numeral 7 designates an inlet line which communicates with the inlet port opened and closed by the lean fuel-air mixture inlet valve 5, while the numeral 8 designates an inlet line communicating with the inlet port opened and closed by the rich fuel-air mixture inlet valve 6. The numeral 9 designates a throttle valve for effecting control of the mixture passing through the inlet line 7, while the numeral 10 designates a throttle valve for effecting control of the mixture passing through the inlet line 8. Designated by the numeral 11 is a shaft for actuating the throttle valves 9 and 10 in unison which shaft 11 is connected through a link mechanism (not shown) to a throttle lever (not shown).

The numeral 12 designates fuel supply means for forming a lean fuel-air mixture which comprises a nozzle projecting into a venturi provided in the inlet line 7, while the numeral 13 designates fuel supply means for forming a rich fuel-air mixture which comprises a nozzle projecting into a venturi provided in the inlet line 8. Designated by the numeral 14 is an air cleaner attached to forward ends of the inlet lines 7 and 8 for cleaning the air supplied to both the lean fuel-air mixture inlet line 7 and the rich fuel-air mixture inlet line 8.

Designated by the numeral 16 is an inlet valve cam shaft supporting at one end thereof a sprocket wheel 17 which is connected through a chain 18 to a sprocket wheel supported on the crank shaft. An exhaust valve cam shaft 20 supports at one end thereof a sprocket wheel 19 which is also connected, through the chain 18, to the crank shaft. The inlet valve cam shaft 16 and exhaust valve cam shaft 20 are driven such that the former rotates at the number of revolutions which is one half the number of revolutions of the latter. The inlet valve cam shaft 16 has secured thereto two cams 21 and 22 (having a phase difference of 180°) for opening and closing the inlet valves 5 and 6 respectively. The cam shaft 20 has secured thereto a cam 24 for opening and closing an exhaust valve 23 which is mounted in an exhaust port maintained in communication with an exhaust gas thermal reactor 26 through an exhaust line 25. The numeral 27 designates an exhaust pipe.

The operation of the engine will now be described. During engine operation, the inlet valves 5 and 6 alternately open and close for one cycle, so that lean fuel-air mixtures supplied from the fuel supply means 12 through the inlet line 7 and rich fuel-air mixture supplied from the fuel supply means 13 through the inlet line 8 are alternately introduced into the cylinder 1 where the fuel-air mixtures are ignited by the sparks produced by an ignition plug (not shown). Gases produced by combustion are vented through the exhaust valve 23 into the exhaust line 25. Thus, the exhaust gases produced by the combustion of rich fuel-air mixtures of low oxygen content and the exhaust gases produced by the combustion of lean fuel-air mixtures of high oxygen content are alternately supplied to the exhaust line 25 where they are mixed. The mixture of these two types of exhaust gases is then introduced into the exhaust gas thermal reactor 26. Accordingly, non-combusted hydrocarbons and carbon monoxide are oxidized by the combustion gases of high oxygen content in the thermal reactor 26. Moreover, since the mixtures burned in the cylinder 1 are either rich mixtures or lean mixtures, the amount of nitrogen oxides is also reduced. If it is desired to increase the output power of the engine, one has only to mount the above-mentioned device in a plurality of numbers.

From the foregoing description, it will be appreciated that the invention offers many advantages. The exhaust gases from the cylinder are high in oxygen content and consequently cleaning of the exhaust gases can be effected by using this cylinder alone, thereby making it possible to prevent an increase in the physical size of the engine. Fouling of the ignition plug by carbon can be prevented. It is possible to reduce the amounts of not only non-combusted hydrocarbons and carbon monoxide but also nitrogen oxides.

By basically adjusting the ignition system such that it is adapted to start combustion with a lean fuel-air mixture, it is possible to reduce the possibility of failure of the ignition to produce flames and start combustion because rich fuel-air mixtures and lean fuel-air mixtures are alternately supplied to the cylinder. Combined with the feature of being able to prevent fouling of the ignition plug due to carbon deposits, this is conducive to stabilized and reliable performance of the engine.

The ignition of the fuel-air mixtures by the ignition plug can be timed such that there is a difference between the cycle in which lean fuel-air mixtures are supplied to the cylinder and the cycle in which rich fuel-air mixtures are supplied thereto. For example, it is possible to cause the mixtures to burn in a stable manner by advancing the timing of supply of lean mixtures.

What I claim is:

1. An internal combustion engine comprising a cylinder, rich fuel-air mixture supply means for supplying rich fuel-air mixture to said cylinder, lean fuel-air mixture supply means for supplying lean fuel-air mixture to said cylinder, a rich fuel-air mixture inlet valve mounted on said cylinder and communicating with said rich fuel-air mixture supply means, a lean fuel-air mixture inlet valve mounted on said cylinder and communicating with said lean fuel-air mixture supply means, an exhaust valve mounted on said cylinder, an exhaust gas thermal reactor communicating with said exhaust valve, means for actuating said inlet valves, and means for actuating said exhaust valve, said rich fuel-air mixture inlet valve and said lean fuel-air inlet valve being actuated alternately whereby rich mixture and lean mixtures can be alternately supplied to the cylinder, said means for actuating said inlet valves comprising an inlet valve cam shaft, and two cams supported by said inlet valve cam shaft, said two cams being disposed such that they are displaced from each other by 180° whereby said rich fuel-air mixture inlet valve and said lean fuel-air inlet valve can be alternately actuated.

2. An internal combustion engine as claimed in claim 1, wherein said means for actuating said exhaust valve comprises an exhaust valve cam shaft, and a cam adapted to actuate said exhaust valve, said exhaust valve cam shaft and said inlet valve cam shaft being driven such that the number of revolutions of the latter is one half that of the former.

3. An internal combustion engine comprising means defining a combustion chamber, means including first inlet valve means for delivering a rich fuel-air mixture to said combustion chamber, means including second inlet valve means for delivering a lean fuel-air mixture to said combustion chamber, ignition means for sequentially igniting fuel mixture within said combustion chamber, exhaust means for exhausting combustion gases from said combustion chamber, and means controlling operation of both said first inlet valve means and said second inlet valve means for alternately delivering to said combustion chamber after each ignition by said ignition means of fuel mixture contained therein one only of said rich fuel-air mixture and said lean fuel-air mixture during operation of said engine.

4. An internal combustion engine according to claim 3 wherein said engine operates with an operating cycle which includes only one fuel intake phase for each said operating cycle, said controlling means operating to alternately deliver one only of said rich and said lean fuel-air mixture during said one fuel intake phase of the each of said operating cycles.

5. An internal combustion engine according to claim 3 wherein said controlling means comprise an inlet valve cam shaft, and two cams supported upon said inlet valve cam shaft, said two cams being disposed such that they are displaced from each other by 180° to alternately actuate said first inlet valve and said second inlet valve.

6. An internal combustion engine according to claim 5 wherein said exhaust means include an exhaust valve, an exhaust valve cam shaft and a cam on said exhaust valve cam shaft adapted to actuate said exhaust valve, said exhaust valve cam shaft and said inlet valve cam shaft being driven such that the number of revolutions of said exhaust valve cam shaft is twice that of the number of revolutions of said inlet valve cam shaft.

* * * * *